US011384438B2

(12) United States Patent
Whitmore et al.

(10) Patent No.: US 11,384,438 B2
(45) **Date of Patent: *Jul. 12, 2022**

(54) CATHODIC CORROSION PROTECTION SYSTEM WITH REBAR MOUNTING ASSEMBLY

(71) Applicant: Vector Remediation Ltd., Winnipeg (CA)

(72) Inventors: David William Whitmore, Winnipeg (CA); Tobias Becker, Whitemouth (CA)

( * ) Notice: Subject to any disclaimer, the term of this patent is extended or adjusted under 35 U.S.C. 154(b) by 390 days.

This patent is subject to a terminal disclaimer.

(21) Appl. No.: 16/674,306

(22) Filed: Nov. 5, 2019

(65) Prior Publication Data

US 2020/0123667 A1 Apr. 23, 2020

Related U.S. Application Data

(63) Continuation-in-part of application No. 15/644,079, filed on Jul. 7, 2017, now Pat. No. 10,745,811.

(51) Int. Cl.

| | |
|---|---|
| ***C23F 13/18*** | (2006.01) |
| ***E04C 5/01*** | (2006.01) |
| ***C23F 13/10*** | (2006.01) |

(52) U.S. Cl.

CPC ..... *C23F 13/18* (2013.01); *C23F 13/10* (2013.01); *E04C 5/015* (2013.01); *C23F 2201/02* (2013.01)

(58) Field of Classification Search

CPC ..... C23F 13/02–13/22; C23F 2201/02; C23F 2213/31–2213/32; E04C 5/015

See application file for complete search history.

(56) References Cited

U.S. PATENT DOCUMENTS 3,803,012 A * 4/1974 Kurr ..... C23F 13/02 204/196.16

5,968,339 A * 10/1999 Clear ..... C23F 13/16 204/196.24

* cited by examiner

*Primary Examiner* — Alexander W Keeling

(74) *Attorney, Agent, or Firm* — Adrian D. Battison; Ade & Company Inc.; Ryan W. Dupuis

(57) ABSTRACT

In a method for cathodically protecting and/or passivating a metal section in an ionically conductive material such as steel reinforcement in concrete or mortar, an impressed current or sacrificial anode is mounted on the metal reinforcing bar by attaching a nut member having a female thread to the metal reinforcing bar by elongate flexible wires attached to the nut member so that the nut member and wires encircle the metal reinforcing bar and rotating a threaded rod member carrying the anode body into the female thread so that a forward end of the rod member engages with a front face of the metal reinforcing bar and pulls on the nut member away from the metal reinforcing bar to tension the wrapping wires.

23 Claims, 8 Drawing Sheets

CATHODIC CORROSION PROTECTION SYSTEM WITH REBAR MOUNTING ASSEMBLY

This application is a continuation in part of application Ser. No. 15/644,079 filed Jul. 7, 2017.

This invention relates to a method and/or an anode assembly for cathodically protecting and/or passivating a metal section in an ionically conductive material using an anode assembly a cell or battery of cells to provide a voltage and more particularly to a mounting assembly for attachment of the anode assembly to the reinforcing bar.

BACKGROUND OF THE INVENTION

Impressed current systems using a battery are known. Such impressed current systems can use other types of power supply including common rectifiers which rectify an AC voltage from a suitable source into a required DC voltage for the impressed current between the anode and the steel. It is also known to provide solar panels to be used in a system of this type.

In all cases such impressed current systems require regular maintenance and checking of the status of the power supply to ensure that the power supply does not fail leading to unexpected and unacceptable corrosion or overprotection of the steel within the structure to be protected. While such maintenance can be carried out and the power supply thus ensured, this is a relatively expensive process.

Alternatively galvanic systems can be used which avoid necessity for any power supply since the voltage between the steel and the anode is provided by selecting a suitable material for the anode which is sufficiently electro-negative to ensure that a current is generated to provide corrosion protection. These systems have obtained considerable success and are widely used.

There are two primary limitations of ordinary galvanic anodes as used in steel reinforced concrete. The first relates to the mass of zinc per anode which, depending on the required current output, limits the useful life of the anode. The second is the actual current output of the anode which may or may not be sufficient to halt corrosion of the steel. The current output is limited by the driving voltage, which is essentially a fixed property and varies with exposure conditions, age of the anode, and build-up of corrosion products over time.

Reference is also made to PCT publications: 2014/012185 published 23 Jan. 2014; 2016/086302 published 9 Jun. 20164; 2017/075699 published 11 May 2017 and 2019/006540 published 10 Jan. 2019; all assigned to the present assignees, the disclosures of which are incorporated herein by reference or may be referenced for more relevant information.

SUMMARY OF THE INVENTION

According to one aspect of the invention there is provided an anode assembly for use in cathodically protecting and/or passivating a metal reinforcing bar in an ionically conductive material, comprising:

an anode body for mounting at least partly within the ionically conductive material for communication of an ionic current through the ionically conductive material to the metal reinforcing bar;

the anode body being constructed and arranged so that when ionically connected to the ionically conductive material a voltage difference is generated between the anode body and the metal reinforcing bar so as to cause a current to flow through the ionically conductive material between the anode body and the metal reinforcing bar so as to provide cathodic protection of the metal reinforcing bar;

and a mounting assembly for fixedly mounting the anode body on the metal reinforcing bar so as to be supported by the bar within the ionically conductive material;

the mounting assembly comprising:

a threaded rod member extending forwardly from the anode body to a forward end of the rod member arranged for engagement with a front face of the metal reinforcing bar;

a nut member having a female thread for engagement onto the threaded rod with the female thread open at both ends so that the forward end can project forwardly of the nut member;

at least one elongate flexible wrapping member arranged to be attached to the nut member;

the nut member and the flexible wrapping member being arranged to encircle the metal reinforcing bar to attach the nut member to the metal reinforcing bar.

That is in a preferred arrangement the combination of the nut member itself and the wrapping member can wrap around the whole rebar so that the pushing forces from the threaded rod on the rebar are applied to the nut member to tension the wrapping member around the rear of the rebar.

The wrapping member may be electrically conductive to as to provide additional electrical connection to the reinforcing bar. However this is not necessary and other non conductive materials can be used such as plastics materials. For example a plastics zip tie can be used, of the type which has a strap portion and a loop portion though which the end of the strap is passed and which locks to the loop at a required location and tension.

It is also possible to provide an arrangement in which the nut piece and the wrapping piece or pieces are not preassembled or pre-connected together. In this embodiment, a zip tie or cable tie, either a single cable tie wrapped around a couple of times or two separate cable ties can be used. The material which wraps around does not need to be metal or electrically conductive. Preferably the cable ties would be part of the nut assembly but they could be separate pieces. Similarly, wire or wires could be separate from the nut portion and its baseplate. The cable ties could be attached to the baseplate by sliding the leading end of the cable tie through a receptacle such as a slot or two slots in the base plate. Alternatively the cable tie could be held by folded metal tabs as described hereinafter.

Thus in one embodiment, said at least one elongate flexible wrapping member is separate from the nut member for attachment thereto.

In this arrangement preferably the nut member includes first and second receptacles each on a respective side of the female thread for attachment thereto of the separate wrapping member. The arrangement can also use one conducting wire and one plastic cable tie.

In one embodiment, the anode body is attached to the threaded rod member so that manual rotation of the anode body drives rotation of the forward end of the threaded rod member through the female thread and against the rebar.

Preferably the forward end of the threaded rod member includes one or more projections for biting into the bar as this increases contact and also reduces the possibility for the attachment to slide along the rebar.

In one embodiment, the threaded rod member is rigidly coupled to the anode body to fixedly hold the anode body at a predetermined distance and orientation relative to the bar. However the anode body may in some cases not be directly attached to the threaded rod but can be attached as separate step of by using intervening mounting components.

In one embodiment, said at least one elongate flexible wrapping member comprises at least two wire portions attached to the nut member and arranged to be wrapped around the metal reinforcing bar and twisted after wrapping together. This can be mounted in a preliminary step following which the threaded rod is fed through the female thread and used to tension the wires to pull against the rear of the rebar.

In this embodiment, preferably one wire portion is attached to the nut member so as to extend outwardly from one side of the female thread and the other wire portion is attached to the nut member as to extend outwardly from an opposed side of the female thread allowing the wire portions to be wrapped around the metal reinforcing bar in opposite directions and twisted together after wrapping back to the front. In this way the twisting is tightened as the tension is applied by the threaded rod. That is the first wire extends from the nut member around one side of the rebar and the other around the other side to cross over at the rear.

More preferably there are four wire portions arranged such that first and second wire portions are attached to the nut member so as to extend outwardly from one side of the female thread and third and fourth wire portions attached to the nut member as to extend outwardly from an opposed side of the female thread. Thus preferably the first and second wire portions are mounted on the nut member so as to be spaced along the metal reinforcing bar from said third and fourth wire portions.

The wire portions can be formed as parts of one or more wires clamped at the nut member but extending outwardly to each side. Thus preferably the first and third wires are a common length of wire and the second and fourth portions are a common length. These can be clamp led at the nut member by folded tabs on the nut member.

In another arrangement, the elongate flexible wrapping member can be formed by a strap arranged to be wrapped around the metal reinforcing bar and fastened to the nut.

According to a second aspect of the invention there is provided an anode assembly for use in cathodically protecting and/or passivating a metal reinforcing bar in an ionically conductive material, comprising:

an anode body for mounting at least partly within the ionically conductive material for communication of an ionic current through the ionically conductive material to the metal reinforcing bar;

the anode body being constructed and arranged so that when ionically connected to the ionically conductive material a voltage difference is generated between the anode body and the metal reinforcing bar so as to cause a current to flow through the ionically conductive material between the anode body and the metal reinforcing bar so as to provide cathodic protection of the metal reinforcing bar;

and a mounting assembly for fixedly mounting the anode body on the metal reinforcing bar so as to be supported by the bar within the ionically conductive material;

the mounting assembly comprising:

a threaded rod member extending forwardly from the anode body to a forward end of the rod member arranged for engagement with an adjacent face of the metal reinforcing bar;

a nut member having a female thread for engagement onto the threaded rod with the female thread open at both ends so that the forward end can project forwardly of the nut member;

and at least two wire portions attached to the nut member and arranged to be wrapped around the metal reinforcing bar and twisted together.

According to another aspect of the invention there is provided an anode assembly for use in cathodically protecting and/or passivating a metal reinforcing bar in an ionically conductive material, comprising:

an anode body for mounting at least partly within the ionically conductive material for communication of an ionic current through the ionically conductive material to the metal reinforcing bar;

the anode body being constructed and arranged so that when ionically connected to the ionically conductive material a voltage difference is generated between the anode body and the metal reinforcing bar so as to cause a current to flow through the ionically conductive material between the anode body and the metal reinforcing bar so as to provide cathodic protection of the metal reinforcing bar;

and a mounting assembly for fixedly mounting the anode body on the metal reinforcing bar so as to be supported by the bar within the ionically conductive material;

the mounting assembly comprising:

a threaded rod member extending forwardly from the anode body to a forward end of the rod member arranged for engagement with a front face of the metal reinforcing bar;

a nut member having a female thread for engagement onto the threaded rod with the female thread open at both ends so that the forward end can project forwardly of the nut member;

the nut member having on each side of the female thread a receptacle for receiving a respective portion of at least one elongate flexible wrapping member arranged to be attached to the nut member to encircle the metal reinforcing bar to attach the nut member to the metal reinforcing bar.

According to another aspect of the invention there is provided a method for cathodically protecting and/or passivating a metal reinforcing bar in an ionically conductive material, comprising:

providing an anode body comprising an anode for communication of an ionic current through the ionically conductive material to the metal reinforcing bar, the anode body being constructed and arranged so that when the anode is ionically connected to the ionically conductive material a voltage difference is generated between the anode and the metal reinforcing bar so as to cause a current to flow through the ionically conductive material between the anode and the metal reinforcing bar so as to provide cathodic protection of the metal reinforcing bar;

and mounting the anode body on the metal reinforcing bar by:

attaching a nut member having a female thread to the metal reinforcing bar by at least one elongate flexible wrapping member so that the nut member and wrapping member encircle the metal reinforcing bar;

and rotating a threaded rod member into the female thread so that a forward end of the rod member engages with a front face of the metal reinforcing bar and pulls on the nut member away from the metal reinforcing bar to tension said at least one wrapping member;

the anode body being carried on the threaded rod member.

The arrangements disclosed herein can be used with an anode body which includes an anode of a material which is less noble than the metal bar so that it is sacrificial.

Alternatively in other embodiments the voltage difference is generated by a storage component of electrical energy with two poles for communicating electrical current generated by release of the electrical energy and by electrically connecting one pole to the metal bar and by electrically connecting the other pole to an anode on the anode body.

The arrangements above this provide a mechanical engagement for the anode body onto the reinforcing bar. This arrangement can provide the following advantages:

The contacts act to bite into reinforcing steel;

The contacts make good connection even if surface of the bar is not clean such as contaminated with rust or concrete residue.

The arrangement is adjustable to different bar sizes/diameters and sizes/roughness caused by corrosion.

The arrangement creates a rigid attachment.

The arrangement supports the anode body at a spaced position from connection point.

The mounting arrangement promotes more uniform current distribution since the anode is held at a position not very close to one bar and therefore passes current more uniformly because of reduced differences in resistance.

The arrangement does not easily rotate around the steel bar like a wire wrap connection.

The connection does not loosen as a result of any rotation of the anode body relative to the bar.

Anode body does not rotate/fall to down position due to gravity

The arrangement allows the installer to position the anode on a selected bar within the section of concrete/mortar to be cast.

The connector allows anodes to be manufactured with a standard threaded rod as the first abutment.

In an arrangement using a power supply, the connection acts to firmly connect one pole of the supply to the reinforcing steel and ensure the other pole is spaced and will not contact the steel as this would cause a short circuit, drain the battery and provide no corrosion protection to the steel.

Different connectors can be provided for different size ranges.

Teeth or knife/sharp edges can be provided on an inside opening of a cavity defined by the hook member to bite into the reinforcing bar.

A concave end and additional teeth on the end of the threaded rod can act to cut into reinforcing bar.

These features ensure secure rigid, physical and electrical connection.

This arrangement can be used with a simple sacrificial anode or can be used with an anode body having an energy storage device. The anode, used with the energy storage device such as a cell or supercapacitor, can be simply an impressed current anode or a combination of an impressed current anode with a separate sacrificial anode component.

The arrangement above using wrapping wires, straps or ties is particularly effective since the nut member can be attached directly in contact with the rebar by the wires and in this way the anode on the threaded rod does not need to be twisted very much to effect tightening. This allows a shorter threaded section and the anode can be installed in a smaller repair by being mounted closer to the steel. When the wires are installed, the wires are wrapped fully around the bar and back to the front side. This reduces the pressure on the twisted section and prevents it from untwisting when the nut is tightened and pressure is applied.

Also in this arrangement the fact that the threaded rod has a forward end which bites into the rebar acts to prevent the possibility of the anode from sliding along the rebar which can occur in arrangements where the anode is attached by wrapping wires alone. The forward end can cut into the surface and can cut through coatings, corrosion products or concrete residue one the bar to ensure a proper electrical contact.

The arrangement herein can be used where the anode is in the form of a plurality of associated anodes all connected to the cell or battery of cells.

The storage component as defined above can be a cell or battery or battery of cells/batteries or it can be a capacitor or a supercapacitor or ultracapacitor which provides a system for storing charge different from conventional electrolytic cells or batteries. A supercapacitor is a high-capacity electrochemical capacitor with capacitance values much higher than other capacitors. These capacitors typically have lower voltage limits than standard or conventional capacitors. They typically store 10 to 100 times more energy per unit volume or mass than standard capacitors, can accept and deliver charge much faster than batteries, and tolerate many more charge and discharge cycles than rechargeable batteries. Supercapacitors do not use the conventional solid dielectric of standard capacitors. They use electrostatic double-layer capacitance or electrochemical pseudo-capacitance or a combination of both instead. Electrostatic double-layer capacitors use carbon electrodes or derivatives with much higher electrostatic double-layer capacitance than electrochemical pseudo-capacitance, achieving separation of charge in a Helmholtz double layer at the interface between the surface of a conductive electrode and an electrolyte. The separation of charge is of the order of a few angstroms (0.3-0.8 nm), much smaller than in a conventional capacitor.

Supercapacitors are a great advancement on normal capacitors being capable of storing a high charge once fully charged. The capacity of a 2.7V 200 F supercapacitor is capable of holding a charge of the order of over 500 C (A×seconds). Typical cathodic protection systems require around 170 to 400 C/m2 of steel per day so such a capacitor is able to provide, when fully charged, enough charge to protect 1 m2 or more of steel for a day. This represents 2-5 mA/m2 current density. In order for example to double this figure then we need to double the capacitance to around 400 F. If the capacitor is recharged on a daily basis, then logistically a system utilising supercapacitor of this size spaced at intervals to provide current for 1 m2 or more of steel can be an effective cathodic protection system. Daily recharging can easily be provided by solar panels, for example, but other means of producing reasonably regular bursts of current could be used as charging components for the supercapacitors. An example of such could be piezoelectric materials which can be incorporated in roads, parking garages, bridges, runways etc. enabling current to be generated by loading and/or movement of the structure or vehicles passing over them.

That is, piezoelectric materials could be used to generate electricity to power an impressed current system directly, or to charge/recharge batteries or capacitors/supercapacitors.

In some embodiments the anode is a sacrificial anode formed of a material which is less noble than the metal section to be protected. However in other cases the anode is not less noble than the metal sections to be protected so that it is the same as the metal, typically steel or is more noble than the steel; so that it is partially or fully inert during the process. If the anode is formed of a sufficiently inert material anode it does not corrode significantly during the flow of the electrons.

High current output is required from the storage component such as a battery. As described above, one pole is connected to the metal section to be protected. Electrons flow from the storage component to the metal section such that corrosion of the metal section is reduced. The other pole is connected to an anode or if suitable, the casing of the storage component itself can be used as the anode. In the case of a zinc-alkaline battery the polarity of the battery is such that the case of the battery, if it is made of a suitable material will act as the anode and will be able to distribute the necessary current through the ionically conductive material such as mortar or concrete. Other batteries, such as most lithium batteries, typically have only a small pole which has the proper polarity which may not be large enough to deliver the required current into the ionically conductive material. A separate anode can be provided for connection to the appropriate pole. The anode may encase or coat the whole storage component such as a battery or capacitor. Anodes can be made of any inert conductive material such as MMO coated titanium or other noble metal or sub-metal, conductive coating, conductive ceramic material etc. and can be embedded in an alkaline mortar or an inert material such as sand which may be dosed with an alkali solution. Stainless steel can also be a suitable current carrier when embedded in mortar or compacted sand dosed with alkali such as a saturated solution of lithium hydroxide. Anodes may also comprise sacrificial materials such as zinc which are less noble than the metal section to be protected.

In one arrangement the anode comprises sacrificial anode material, or the anode, which is sacrificial to the metal section, is collated with or in electrical contact with a body of sacrificial anode material which gives a boost of current until the sacrificial anode material is consumed, following which the current discharge is through the anode.

Typically the single unit comprising the storage component and the anode or anodes is at least partly buried in the ionically conductive material. However application to the surface or other modes of mounting where the anode is in ionic contact with the material can be used.

In one particularly preferred arrangement the storage component comprises a cell with an outer case wherein the case is fully or partially formed of the anode material so that the anode is formed by the outer case either by an outer surface of the same material or as a coating or layer on the exterior of the case. In this case the outer case or at least the outer layer can be formed of a material which is more noble than steel. In this arrangement the anode forms directly the outer case of the cell where the case contains and houses the cathode material of the cell the electrolyte, the anode material and other components of the cell. That is, in this embodiment, the anode is defined by a layer or coating on the outer surface of the storage component itself or actually as the outer surface of the storage component and not as an additional element which is separate from the storage component. Where the storage component is a cell, the outer case of the cell can directly carry the material of the anode or even the outer case of the cell is the anode. The anode material may cover the whole surface or may be a partial covering leaving other areas exposed.

In another case the case and the anode are formed independently and the anode forms a separate body which conforms in shape to the outer case of the cell. Typically such cells are cylindrical but other shapes can be used. This arrangement is particularly applicable where the cell is replaceable rather than rechargeable to introduce the additional energy after the original cell is sufficiently depleted to be no longer effective.

In another case the anode is a separate body which is electrically connected to one terminal of the storage component.

The above features can be preferably used for protection of steel reinforcing or structural members in concrete or mortar material where it is well known that corrosion can cause breakdown of the concrete due to the expansive forces of the corrosion products and due to the reduction to the steel strength. However uses in other situations can arise.

The term impressed current anode used herein is intended to distinguish from the sacrificial anode where the sacrificial anode is formed of a material, typically of zinc, which is less noble than the metal section so that it preferentially corrodes relative to the metal section to be protected. The impressed current anode is one which is used in conjunction with an external power supply and does not need to be less noble than the metal section. Typically such impressed current anodes are formed of titanium, platinum, niobium, carbon and other noble metals and oxides which do not corrode readily, or they can be formed of iron or less noble materials such as zinc.

For use during a sacrificial or galvanic phase of operation of the above method, the ionically conductive filler material preferably contains at least one activator to ensure continued corrosion of the sacrificial anode. However the activator can also be located at other positions in the system. Suitable filler materials can be in the form of solids, gels or liquids.

Gels can include carbomethyl cellulose, starches and their derivatives, fumed silica or polymer gel electrolytes, e.g. acrylic acid in a potassium hydroxide solution or polyvinyl chloride/acetate-KOH composites with additions of bentonite, propylene carbonate and or alumina. The alkali hydroxide in these gels acts as a suitable activator.

Suitable activators include alkali hydroxides, humectants, catalytic materials and other materials which are corrosive to the sacrificial anode metal. Activators may be used alone or in combination.

For use during a sacrificial or galvanic phase of operation of the above method, the ionically conductive filler material preferably has a pH sufficiently high for corrosion of the sacrificial anode to occur and for passive film formation on the sacrificial anode to be avoided. Alternatively, the filler may have a lower pH and/or contain other activators for corrosion of the sacrificial anode to occur and for passive film formation on the sacrificial anode to be avoided.

The anode and methods herein are preferably designed for use where the metal section is steel and the ionically conductive material is concrete or mortar.

The anode apparatus including the impressed current and sacrificial components is typically buried in the concrete or other solid material so that it is fully encased by the concrete or a filler material, but this is not essential and the anode may be only partially buried or in direct or indirect physical or ionic contact with the concrete.

The anode apparatus including the impressed current and sacrificial components may be surrounded by an encapsulating material or ionically conducting filler material which may be a porous material or porous mortar material. Suitable encapsulating materials can be inorganic or organic and may be any ionically conductive cementitious, polymer or non-cementitious material or mortar including geopolymers or modified Portland cements. The encapsulating material may be solid, gel or liquid and may be deformable.

The power supply may include a solar panel which drives the impressed current anode and rechargeable galvanic anode so as to provide long term protection when the solar power is on and off.

The construction and methods proposed herein are designed particularly where the metal section is steel and the ionically conductive material is concrete or mortar. However the same arrangements may be used in other corrosion protection systems such as for pipes or other constructions in soil, and in many other systems where such anodes can be used.

Preferably the assembly includes a reinforcing layer, such as disclosed in U.S. Pat. No. 7,226,532 issued Jun. 5, 2007 to Whitmore, the disclosure of which is incorporated by reference or to which reference may be made for further details not disclosed herein, to restrain and resist forces such as expansion, contraction and deformation forces which may be caused by corrosion of the anodes, deposition of sacrificial anode ions and other physical/environmental forces such as freezing, thawing, wetting, drying and thermal expansion/contraction.

BRIEF DESCRIPTION OF THE DRAWINGS

Embodiments of the invention will now be described in conjunction with the accompanying drawings in which.

In the drawings like characters of reference indicate corresponding parts in the different figures.

DETAILED DESCRIPTION

Figure 1:
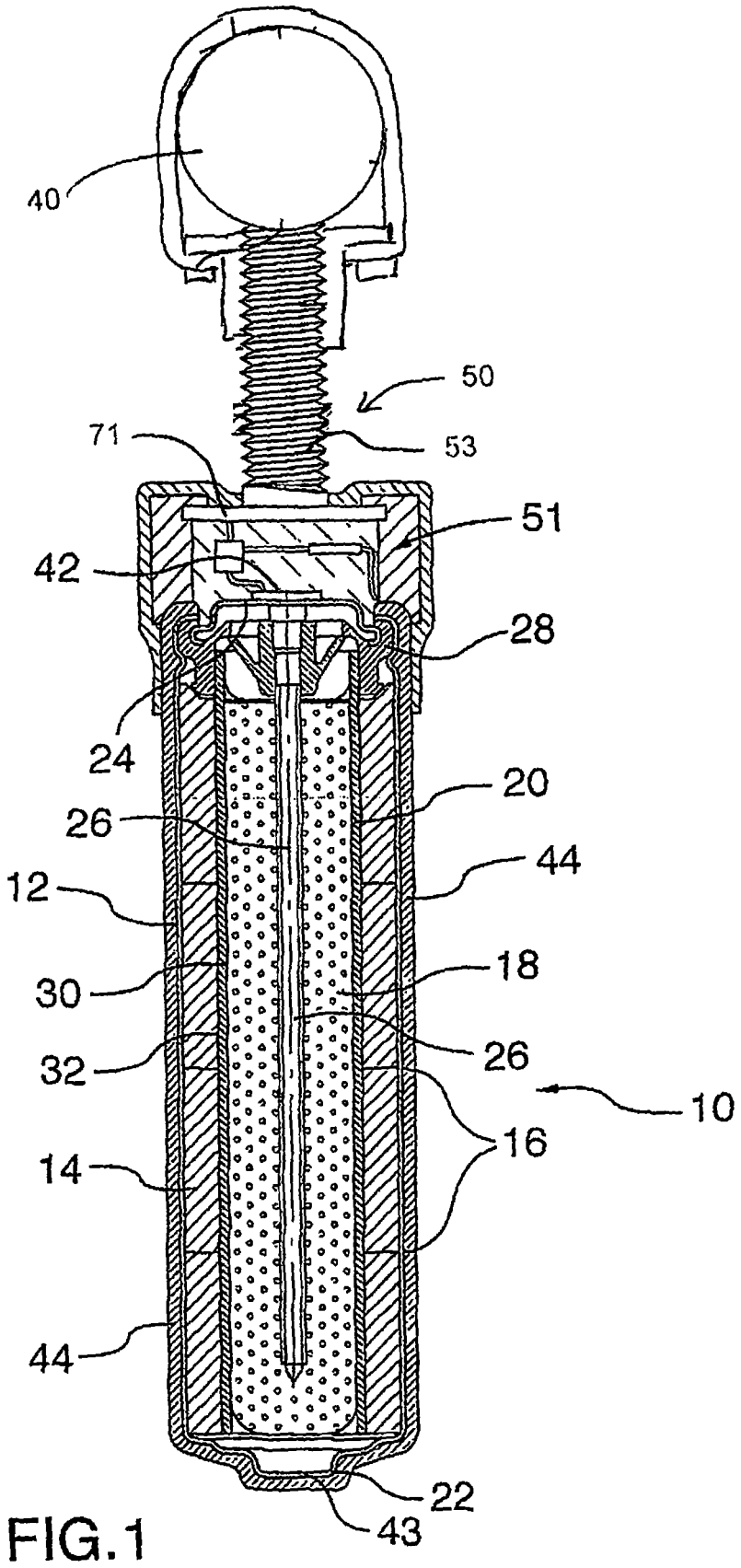
FIG. 1 is a cross-sectional view of an anode assembly including a mounting method for attachment of the anode body to the reinforcing bar according to the present invention.

In the example shown in FIG. 1 there is provided a cell which may be rechargeable or may be a simple non-rechargeable cell. The cell may form part of the anode structure or the anode and the cell may be physically separated. As shown in FIG. 1, an anode body 10 is defined by a typical alkaline manganese dioxide-zinc rechargeable cell comprises the following main units: a steel can 12 defining a cylindrical inner space, a manganese dioxide cathode 14 formed by a plurality of hollow cylindrical pellets 16 pressed in the can, a zinc anode 18 made of an anode gel and arranged in the hollow interior of the cathode 14, and a cylindrical separator 20 separating the anode 18 from the cathode 14. The ionic conductivity (electrolyte) between the anode and the cathode is provided by the presence of potassium hydroxide, KOH, electrolyte added into the cell in a predetermined quantity. Other types of rechargeable cells comprise similar main components (can, cathode, anode, separator and electrolyte) but the composition of the components may differ. Some of the types of cell may however be of a different construction such as lead/acid cells or lithium cells.

The can 12 is closed at the bottom, and it has a central circular pip 22 serving as the positive terminal. The upper end of the can 12 is hermetically sealed by a cell closure assembly which comprises a negative cap 24 formed by a thin metal sheet, a current collector nail 26 attached to the negative cap 24 and penetrating deeply into the anode gel to provide electrical contact with the anode, and a plastic top 28 electrically insulating the negative cap 24 from the can 12 and separating gas spaces formed beyond the cathode and anode structures, respectively.

The material of separator 20 consists of two different materials, i.e.: a first material 30 made of fibrous sheet material wettable by the electrolyte, and a second material 32 being impermeable to small particles but retaining ionic permeability. An expedient material for the first layer is a sheet material of non-woven polyamide fiber, which is absorbent and serves as a reservoir for electrolyte. The macro-porous structure of the absorbent layer cannot prevent internal shorting by zinc dendrites or deposits during discharge/charge cycling.

Shorting is prevented by the second 32 material which may be a layer or layers of micro-porous or non-porous material which may be laminated to or coated onto the fibrous sheet material. One suitable material is one or more cellophane membranes laminated to the non-woven polyamide sheet. Another is one or more coatings of regenerated cellulose or viscose coated onto and partially impregnating the non-woven polyamide sheet, resulting in a composite material.

Other types of rechargeable cells may be used. In the present arrangement, the type described above is used in a method for cathodically protecting and/or passivating a metal section such as steel reinforcing bar 40 in an ionically conductive material such as concrete 41. The cell therefore includes a first terminal 42 and a second terminal 43 defined by the outer casing 12. The first terminal 42 is connected to the pin or nail 26 which is engaged into the anode material 18. The terminal 42 connects to a connecting wire 42A which extends from the terminal 42 for eventual connection to the steel reinforcing bar 40 as shown in FIG. 1 through the mounting assembly generally indicated at 50 which mechanically and electrically attaches the anode body to the bar 40.

In FIG. 1, an anode 44 is applied as a coating onto the casing 12 of the cell. In this embodiment the anode 44 is of an inert material so that it is more noble than steel. Examples of such materials are well known. Thus the anode material 44 does not corrode or significantly corrode during the cathodic protection process.

In this arrangement the application of the anode 44 onto the outside surface of the casing 12 provides the structure as a common single unit where the anode is directly connected to the cell and forms an integral element with the cell. Anode 44 may comprise one or more layers and may include a mixed metal oxide (MMO), catalytic or sub-oxide layer.

In this embodiment, as the anode 44 is formed of an inert material which does not corrode in the protection process, the anode and the cell contained therein can be directly incorporated or buried in the concrete or other ionically conductive material without the necessity for an intervening encapsulating material such as a porous mortar matrix. As there are no corrosion products there is no requirement to absorb such products or the expansive forces generated thereby. As the process does not depend upon continued corrosion of a sacrificial anode, there is no necessity for activators at the surface of the anode. As the chemical reaction at the surface of any inert anode during operation generates acid (or consumes alkali) it is beneficial for the anode to be buried in an alkaline material such as concrete or high alkalinity mortar to prevent material near the anode from becoming acidic. If desired, additional alkali may be added to the concrete or other material the anode is in contact with.

The apparatus shown herein includes an anode body generally indicated at 10 which is connected to the reinforcing bar 40 by the mounting assembly generally indicated at 50. In addition, the anode body includes a current limiting system generally indicated at 51 which limits the flow of current from the anode body to the bar 40, which is not part of the present invention.

As previously described, the anode body can be defined by a power supply typically in the form of a cell with the anode 44 on the outside surface of the cell and with the other terminal of the cell provided at the end of the cell for connection to the bar 40.

In other embodiments described hereinafter the cell can be omitted in which case the anode body comprises a sacrificial material which is less noble than the steel rebar, such as zinc where a voltage between the anode and the bar comprises the galvanic voltage between the two metal components.

In yet another embodiment, the anode body can comprise a combination of both an impressed current anode and a sacrificial anode.

In this way the anode body is constructed and arranged so that when the anode is ionically connected to the concrete, a voltage difference is generated between the anode 44 and the bar 40 so as to cause a current to flow through the concrete between the anode and the bar 40 so to provide cathodic protection and/or passivation of the reinforcing bar in the concrete.

Figure 2:
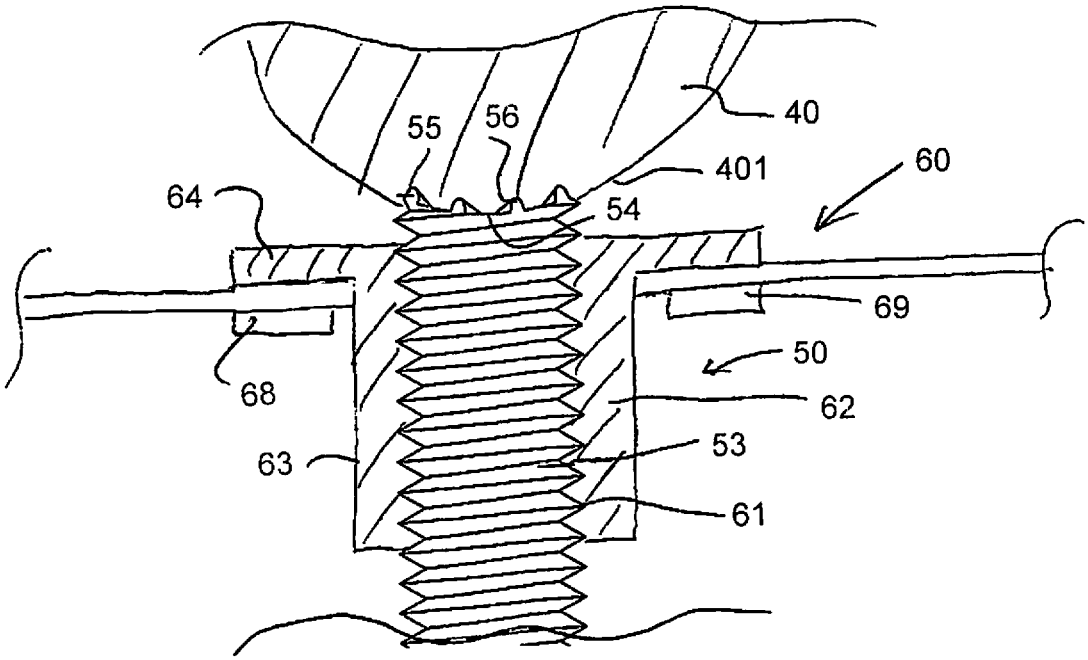
FIG. 2 is an enlarged view of the mounting of the anode body of FIG. 1.
Figure 3:
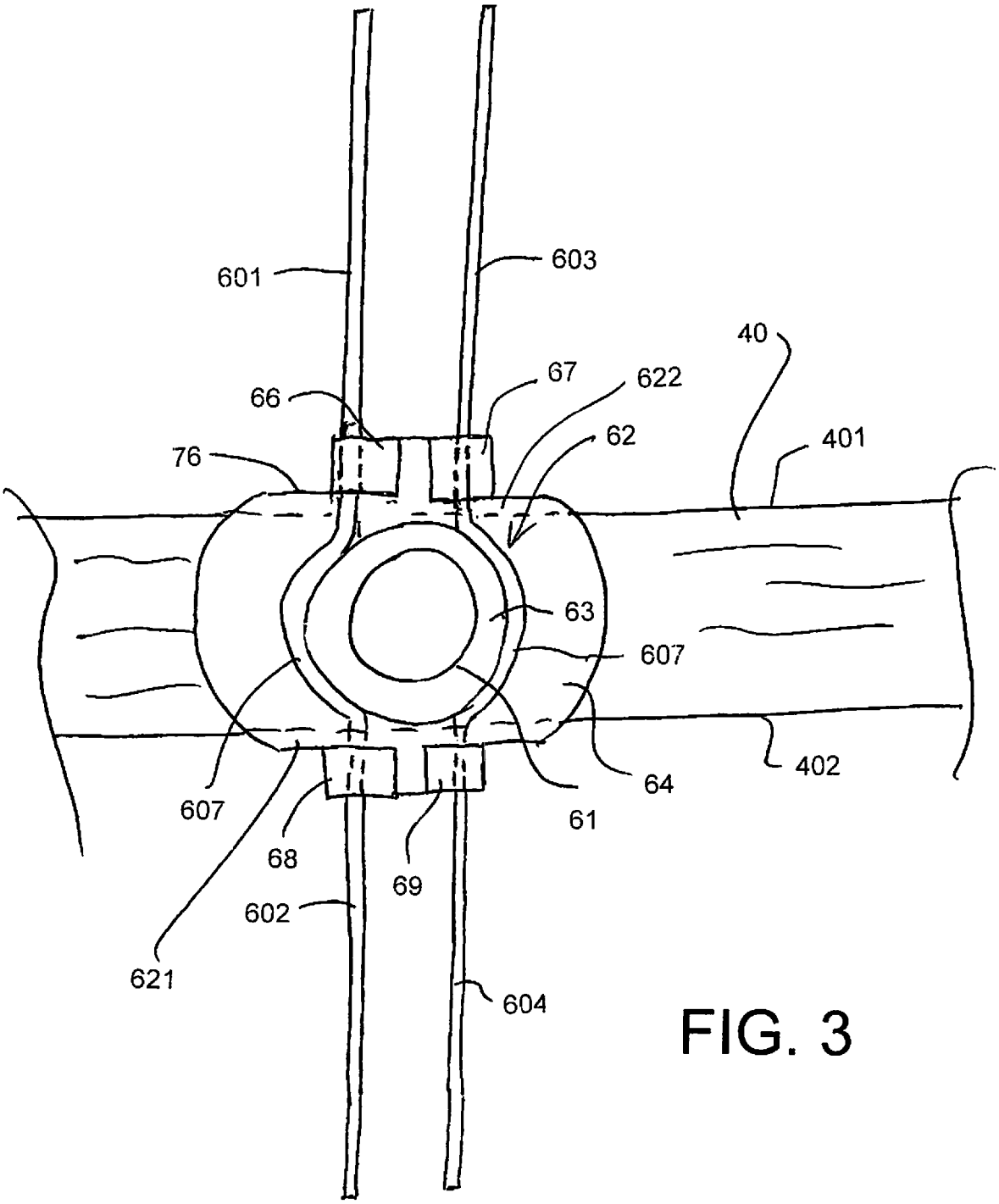
FIG. 3 is a top plan view of the nut member and wrapping wires of the mounting of FIG. 1.
Figure 4:
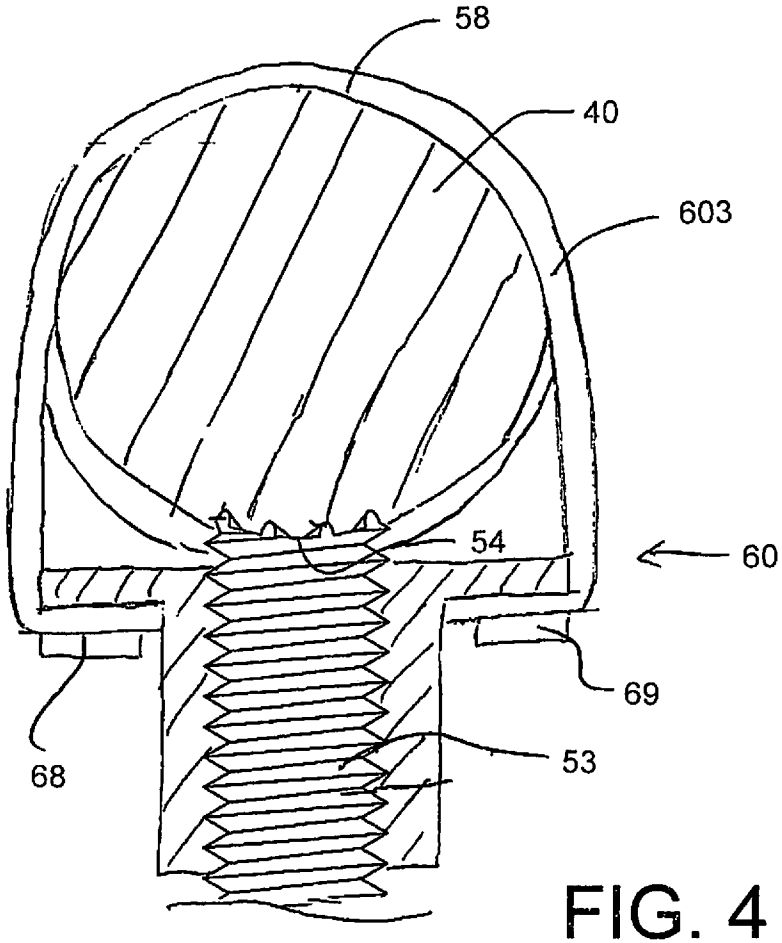
FIG. 4 is an enlarged view of the mounting of FIG. 1 taken as a cross-section transverse to the reinforcing bar.

In the embodiment shown in FIGS. 1, 3 and 4, the mounting assembly 50 comprises a threaded rod 53 which is attached at one end to the anode body 10. An opposed end 54 of the threaded rod forms a front face for engaging one side face of the bar 40. As shown in FIGS. 2 and 4, the end face 54 of the threaded rod 53 includes a peripheral circular edge 55 and intervening projections 56 which are arranged to bite into the surface of the bar 40 when in compressed contact therewith.

The mounting assembly 50 further comprises wrapping member 60 for engaging generally the opposed the face of the bar 40 at a surface 58. In general the wrapping member 60 contacts the opposite or rear surface of the bar 40 at least at two positions and on either side of a diameter extending through the bar 40 from the face 54. In this way the bar 40 is contacted by the front face 54 and the inside surface of the wrapping member 60 to provide a stable engagement.

In this embodiment a female threaded portion 61 is provided by a threaded hole through a nut member 62. A screw action pulling the nut member 62 member toward the anode body is therefore provided by rotating the rod 53. This can most effectively be done by grasping manually the anode body and using it as a handle to turn the rod 53. Of course this requires a strong connection between the bottom end of the rod 53 and the anode body. In the arrangement shown in FIG. 2, this connection is provided by a base plate 71 attached onto the bottom end of the rod 53 and engaged firmly into the upper end of the anode body. In an arrangement using a solid anode of a sacrificial material, the rod 53 can be cast into the interior of the anode body to provide the necessary structural and electrical connection.

The mounting assembly for fixedly mounting the anode body 10 on the metal reinforcing bar 40 so as to be supported by the bar within the ionically conductive material includes the threaded rod 53, the nut member 62 with the female thread 61 and the wrapping member 60.

The threaded rod member 53 extends forwardly from the anode body 10 to the forward end 54 of the rod member 53 arranged for engagement with a front face 401 of the metal reinforcing bar 40. The nut member 62 has the female thread 61 extending therethrough so that the thread forms an open end for insertion of the rod 53 and a second open end at the bar so that the front face can project through the open end for engagement onto the reinforcing bar.

The nut member 62 in this embodiment is connected to at least one elongate flexible wrapping member 60 attached to the nut member 62 with the nut member 62 and the attached flexible wrapping member 60 being arranged to encircle the metal reinforcing bar to attach the nut member 62 to the metal reinforcing bar 40.

The nut member comprises a sleeve portion 63 surrounding the rod 53 with a flange or base plate 64 at one end of the sleeve lying in a radial plane of the axis of the rod.

In this embodiment, the elongate flexible wrapping member 60 comprises four wire portions 601, 602, 603 and 604. The portions 601 and 602 form parts of a common wire strip and the portions 603 and 604 form part of a common wire strip. These strips are attached to the nut member and arranged to be wrapped around the metal reinforcing bar 40 and twisted together at a twisted portion 605, 606.

Figure 5:
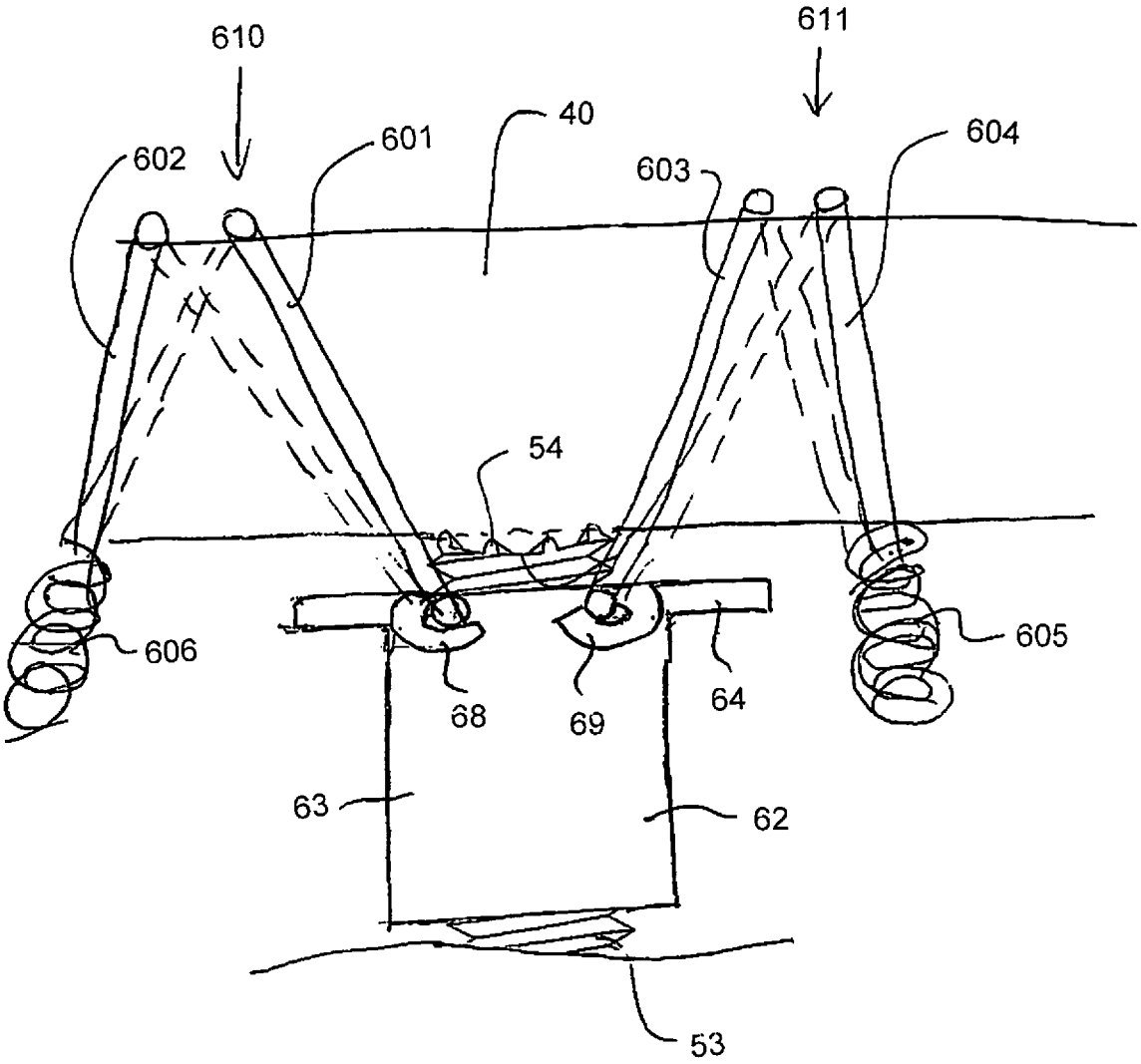
FIG. 5 is a side elevational view of the mounting of FIG. 4.

The strips forming the wire portions are attached to the nut member by lying across the underside of the flange 64 with a curved portion 607 wrapped around the sleeve 63 and by being clamped onto the underside of the flange 64 by respective tabs 66, 67 .and 68, 69. Thus the flange 64 which is generally flat is cut at slit lines 76 to form the tabs which are then folded onto the underside of the flange 64 as best shown in FIG. 5 to clamp around the wires strips and hold them against the flange. In this way the wire portions 601 and 603 are clamped to the nut member and extend outwardly from one side 621 of the female thread sleeve 63 and the other wire portion is attached to the nut member as to extend outwardly from an opposed side 622 of the female thread sleeve 63 allowing the wire portions to be wrapped around the metal reinforcing bar 40 in opposite directions to opposite sides 401, 402 of the bar 40 and twisted together at 605, 606.

As shown best in FIGS. 3 and 5, the wire portions 601, 602 are mounted on the nut member 62 so as to be spaced along the metal reinforcing bar at a position 610 from said third and fourth wire portions at a position 611. This holds the nut member stably positioned relative to the front face 54 of the rod 53 since the nut member is pulled toward the bar 40 in both directions to both sides of the rod 53.

Figure 6:
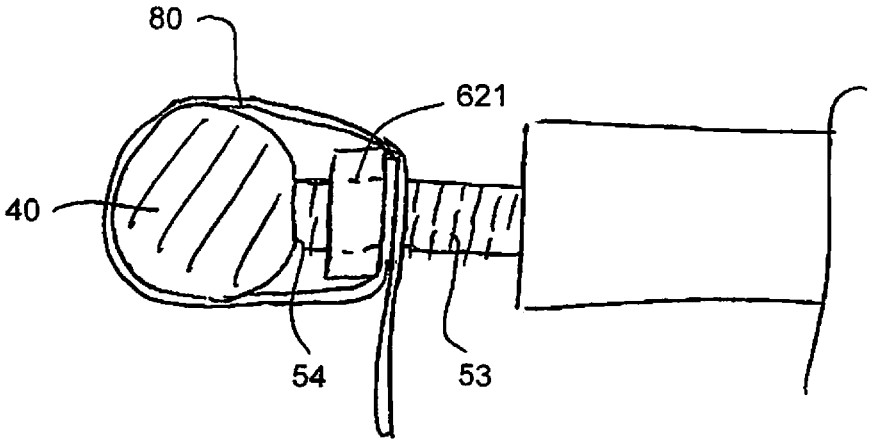
FIG. 6 is a cross-sectional view of an anode assembly including a further embodiment of a mounting method for attachment of the anode body to the reinforcing bar according to the present invention.
Figure 7:
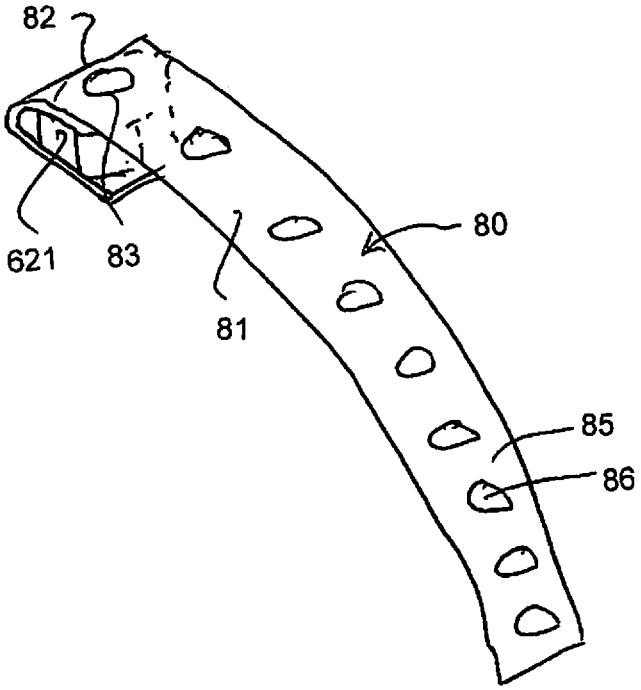
FIG. 7 is an isometric view of the arrangement of FIG. 7.

In an alternative arrangement shown in FIGS. 6 and 7, an elongate flexible wrapping member 80 for pulling the nut 621 toward the bar 40 comprises a strap 81 arranged to be wrapped around the bar 40 and fastened to the nut.

The strap has a width much greater than the wires so that the single strap sits stably in the bar and pulls symmetrically on the nut. The strap has one end 82 fixedly attached to the nut 621 at top and bottom faces of the nut 621 with holes 83 through which the rod 53 can pass as it is fed through the thread in the nut member. The other end 85 of the strap has a series of holes 86 so that when wrapped around the rod and back to the nut member, the insertion of the rod 53 through the selected one of the holes 86 connects the strap back to the nut member so that they encircle the bar 40.

In the method of use, therefore the arrangement herein allows the nut member 62 to be first attached to the metal reinforcing bar 40 by the elongate flexible wrapping member 60 so that the nut member and wrapping member encircle the metal reinforcing bar and hold the nut member close against the bar 40. Subsequently the rod 53 is inserted and rotated into the female thread so that the forward end of the rod member engages with a front face of the metal reinforcing bar and pulls on the nut member away from the metal reinforcing bar to tension the wrapping member.

Figure 8:
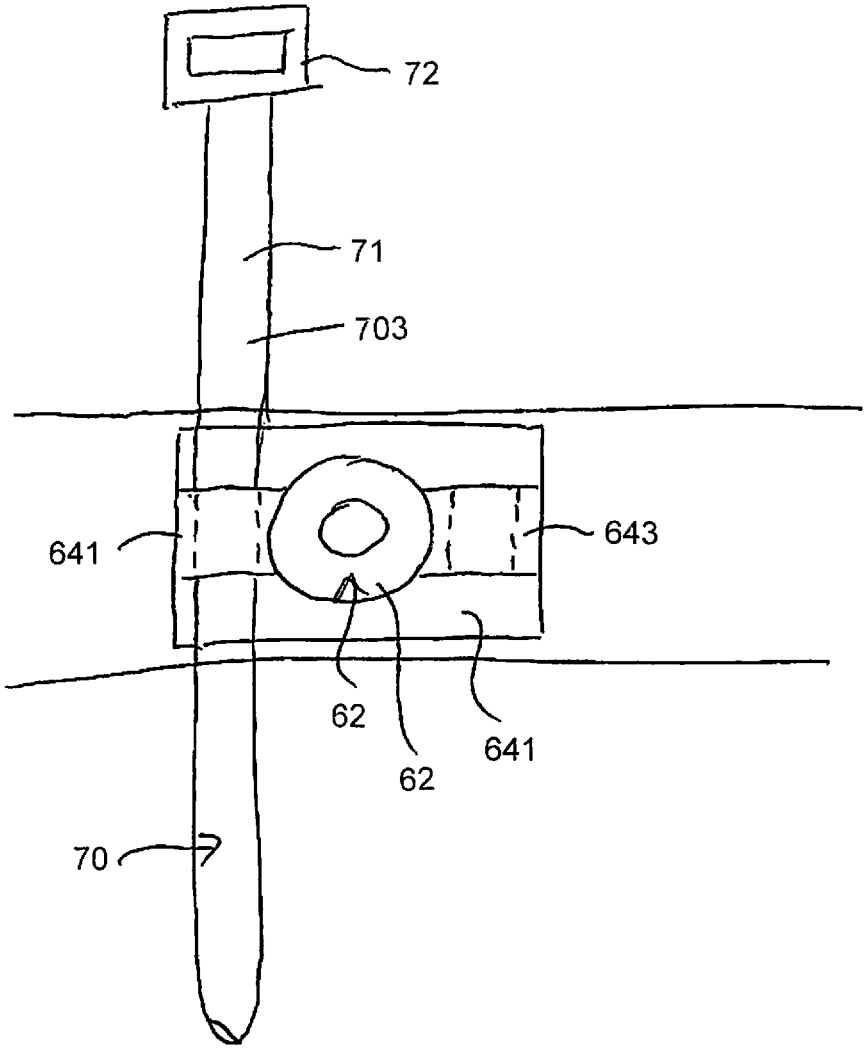
FIG. 8 is a top plan view of the nut member and wrapping wires of an alternative embodiment of the mounting of FIG. 1 which uses cable ties.
Figure 9:
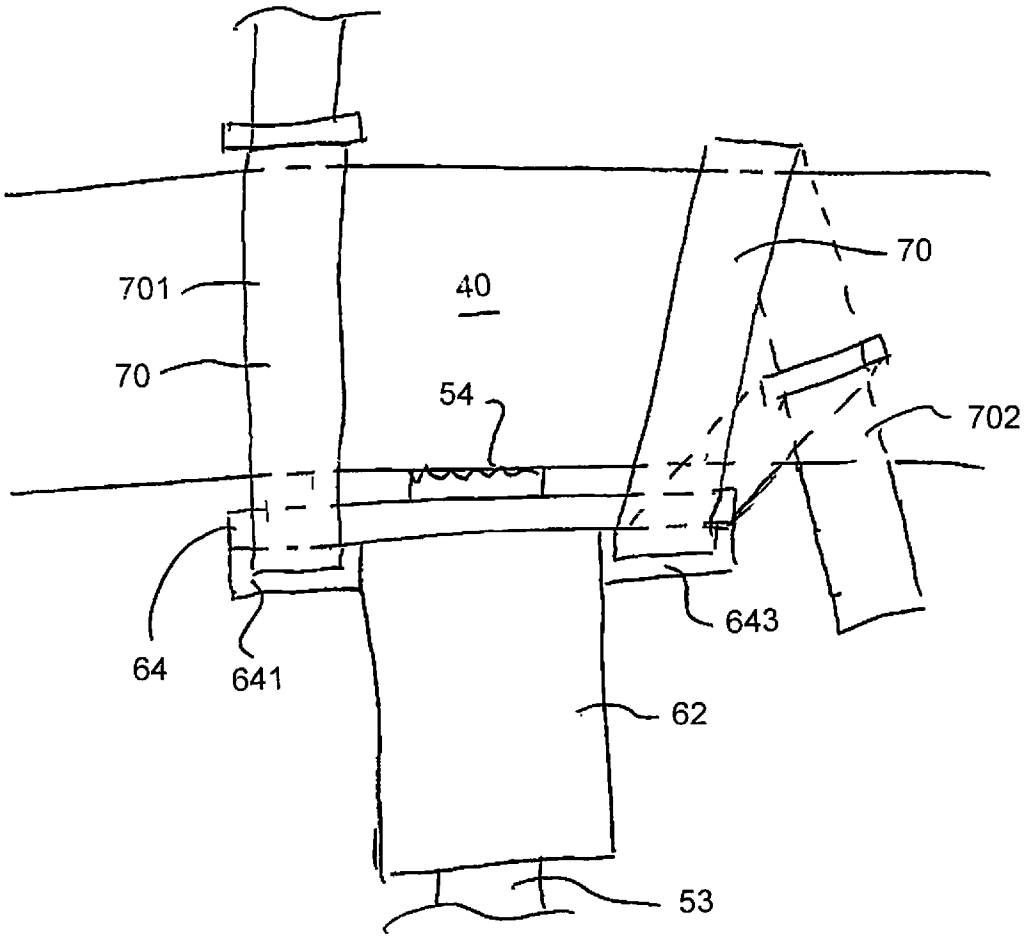
FIG. 9 is a side elevational view of the mounting of FIG. 7.

In FIGS. 8 and 9 is shown an alternative arrangement which uses cable or zip ties 70 to attach the base plate 641 to the bar 40. The zip ties are of the type which has a strap 71 and a loop 72 which connect and hold the strap at the required tension. This as shown in FIG. 8, the base plate 641 has respective loops or receptacles 642 and 643 on respective sides of the sleeve portion 63 of the nut member 62. The loops form an opening through which the strap of the tie 70 can be passed to attach the tie to the base plate with the loop extending to one side of the bar 40 and the strap to the other side allowing them to be wrapped around and connected either at the rear as shown in FIG. 9 at 701 or at the front as shown at 702. The ties can be attached to the nut member when supplied as shown at 703 which is attached to loop 641 or can be a separate component supplied separately as the ties are of course common, as shown at loop 643.

While the plastic ties are not conductive, the connection can be provided by the front face 54 alone or ties of a conductive material may be used.

While the wires of the previous embodiment are shown attached to the nut member, it is also possible that the wires can be supplied as separate elements for insertion through the loops 641, 643 and wrapped around the bar for twisting together.

Since various modifications can be made in my invention as herein above described, and many apparently widely different embodiments of same may be made within the spirit and scope of the claims without department from such spirit and scope, it is intended that all matter contained in the accompanying specification shall be interpreted as illustrative only and not in a limiting sense.

The invention claimed is:

1. An anode assembly for use in cathodically protecting and/or passivating a metal reinforcing bar in an ionically conductive material, comprising:

an anode body for mounting at least partly within the ionically conductive material for communication of an ionic current through the ionically conductive material to the metal reinforcing bar;

the anode body being constructed and arranged so that when ionically connected to the ionically conductive material a voltage difference is generated between the anode body and the metal reinforcing bar so as to cause a current to flow through the ionically conductive material between the anode body and the metal reinforcing bar so as to provide cathodic protection of the metal reinforcing bar;

and a mounting assembly for fixedly mounting the anode body on the metal reinforcing bar so as to be supported by the bar within the ionically conductive material;

the mounting assembly comprising:

a threaded rod member extending forwardly from the anode body to a forward end of the rod member arranged for engagement with a front face of the metal reinforcing bar;

a nut member having a female thread for engagement onto the threaded rod with the forward end of the rod member projecting forwardly of the nut member;

at least one elongate flexible wrapping member arranged to be attached to the nut member;

the nut member and the flexible wrapping member being arranged to encircle the metal reinforcing bar to attach the nut member to the metal reinforcing bar.

2. The anode assembly according to claim 1 wherein the anode body is attached to the threaded rod member so that manual rotation of the anode body drives rotation of the forward end of the threaded rod member into the female thread.

3. The anode assembly according to claim 1 wherein the forward end of the threaded rod member includes one or more projections for biting into the bar.

4. The anode assembly according to claim 1 wherein the threaded rod member is rigidly coupled to the anode body to fixedly hold the anode body at a predetermined distance and orientation relative to the bar.

5. The anode assembly according to claim 1 wherein said at least one elongate flexible wrapping member comprises at least two wire portions attached to the nut member and arranged to be wrapped around the metal reinforcing bar and twisted together.

6. The anode assembly according to claim 5 wherein one wire portion is attached to the nut member so as to extend outwardly from one side of the female thread and the other wire portion is attached to the nut member as to extend outwardly from an opposed side of the female thread allowing the wire portions to be wrapped around the metal reinforcing bar in opposite directions and twisted together.

7. The anode assembly according to claim 5 wherein first and second wire portions are attached to the nut member so as to extend outwardly from one side of the female thread and third and fourth wire portions attached to the nut member as to extend outwardly from an opposed side of the female thread.

8. The anode assembly according to claim 7 wherein said first and second wire portions are mounted on the nut member so as to be spaced along the metal reinforcing bar from said third and fourth wire portions.

9. The anode assembly according to claim 1 wherein said at least one elongate flexible wrapping member comprises a strap arranged to be wrapped around the metal reinforcing bar and fastened to the nut.

10. An anode assembly for use in cathodically protecting and/or passivating a metal reinforcing bar in an ionically conductive material, comprising:

an anode body for mounting at least partly within the ionically conductive material for communication of an ionic current through the ionically conductive material to the metal reinforcing bar;

the anode body being constructed and arranged so that when ionically connected to the ionically conductive material a voltage difference is generated between the anode body and the metal reinforcing bar so as to cause a current to flow through the ionically conductive material between the anode body and the metal reinforcing bar so as to provide cathodic protection of the metal reinforcing bar;

and a mounting assembly for fixedly mounting the anode body on the metal reinforcing bar so as to be supported by the bar within the ionically conductive material;

the mounting assembly comprising:

a threaded rod member extending forwardly from the anode body to a forward end of the rod member arranged for engagement with an adjacent face of the metal reinforcing bar;

a nut member having a female thread for engagement onto the threaded rod with the forward end of the rod member projecting forwardly of the nut member;

and at least two wire portions attached to the nut member and arranged to be wrapped around the metal reinforcing bar and twisted together.

11. The anode assembly according to claim 10 wherein one wire portion is attached to the nut member so as to extend outwardly from one side of the female thread and the other wire portion is attached to the nut member as to extend outwardly from an opposed side of the female thread allowing the wire portions to be wrapped around the metal reinforcing bar in opposite directions and twisted together.

12. The anode assembly according to claim 10 wherein first and second wire portions are attached to the nut member so as to extend outwardly from one side of the female thread and third and fourth wire portions attached to the nut member as to extend outwardly from an opposed side of the female thread.

13. The anode assembly according to claim 12 wherein said first and second wire portions are mounted on the nut member so as to be spaced longitudinally of the metal reinforcing bar from said third and fourth wire portions.

14. An anode assembly for use in cathodically protecting and/or passivating a metal reinforcing bar in an ionically conductive material, comprising:

an anode body for mounting at least partly within the ionically conductive material for communication of an ionic current through the ionically conductive material to the metal reinforcing bar;

the anode body being constructed and arranged so that when ionically connected to the ionically conductive material a voltage difference is generated between the anode body and the metal reinforcing bar so as to cause a current to flow through the ionically conductive material between the anode body and the metal reinforcing bar so as to provide cathodic protection of the metal reinforcing bar;

and a mounting assembly for fixedly mounting the anode body on the metal reinforcing bar so as to be supported by the bar within the ionically conductive material;

the mounting assembly comprising:

a threaded rod member extending forwardly from the anode body to a forward end of the rod member arranged for engagement with a front face of the metal reinforcing bar;

a nut member having a female thread for engagement onto the threaded rod with the forward end of the rod member projecting forwardly of the nut member;

the nut member having on each side of the female thread a receptacle for receiving a respective portion of at least one elongate flexible wrapping member arranged to be attached to the nut member to encircle the metal reinforcing bar to attach the nut member to the metal reinforcing bar.

15. A method for cathodically protecting and/or passivating a metal reinforcing bar in an ionically conductive material, comprising:

providing an anode body comprising an anode for communication of an ionic current through the ionically conductive material to the metal reinforcing bar, the anode body being constructed and arranged so that when the anode is ionically connected to the ionically conductive material a voltage difference is generated between the anode and the metal reinforcing bar so as to cause a current to flow through the ionically conductive material between the anode and the metal reinforcing bar so as to provide cathodic protection of the metal reinforcing bar;

and mounting the anode body on the metal reinforcing bar by:

attaching a nut member having a female thread to the metal reinforcing bar by at least one elongate flexible wrapping member so that the nut member and wrapping member encircle the metal reinforcing bar;

and rotating a threaded rod member into the female thread so that a forward end of the rod member engages with a front face of the metal reinforcing bar and pulls on the nut member away from the metal reinforcing bar to tension said at least one wrapping member;

the anode body being carried on the threaded rod member.

16. The method according to claim 15 wherein the threaded rod member is driven in rotation by rotating the anode body.

17. The method according to claim 15 wherein the forward end of the threaded rod member includes one or more projections which bite into the bar.

18. The method according to claim 15 wherein the anode body is rigidly coupled to the threaded rod member and fixedly held at a predetermined distance and orientation relative to the bar.

19. The method according to claim 15 wherein said at least one elongate flexible wrapping member comprises at least two wire portions which attached to the nut member and which are wrapped around a rear face of the metal reinforcing bar and twisted together at the front face.

20. The method according to claim 19 wherein one wire portion is attached to the nut member so as to extend outwardly from one side of the female thread and the other wire portion is attached to the nut member as to extend outwardly from an opposed side of the female thread allowing the wire portions to be wrapped around the metal reinforcing bar in opposite directions and twisted together at the front face.

21. The method according to claim 19 wherein first and second wire portions are attached to the nut member so as to extend outwardly from one side of the female thread and third and fourth wire portions attached to the nut member as to extend outwardly from an opposed side of the female thread, said first and second wire portions are mounted on the nut member so as to be spaced along the metal reinforcing bar from said third and fourth wire portions, wrapping the wire portions around the metal reinforcing bar and twisting together the first and third wire portions on one part of the metal reinforcing bar and together the second and fourth wire portions on another part of the metal reinforcing bar spaced along the reinforcing bar.

22. The method according to claim 15 wherein said at least one elongate flexible wrapping member is separate from the nut member for attachment thereto.

23. The method according to claim 22 wherein the nut member includes first and second receptacles each on a respective side of the female thread for attachment thereto of the separate wrapping member.

* * * * *